US005883583A

United States Patent [19]

Kishino

[11] Patent Number: 5,883,583

[45] Date of Patent: Mar. 16, 1999

[54] IMAGING A COMPLETION STRING IN A WELLBORE

[75] Inventor: Ashley C. Kishino, Houston, Tex.

[73] Assignee: Schlumberger Technology Corporation, Sugar Land, Tex.

[21] Appl. No.: 895,080

[22] Filed: Jul. 16, 1997

[51] Int. Cl.[6] ..... G01V 3/00

[52] U.S. Cl. ..... 340/853.3; 340/853.1; 73/152.57; 367/73

[58] Field of Search ..... 367/73, 86; 340/853.1, 340/854.5, 853.3; 73/152.45, 152.52, 152.54, 152.57

[56] References Cited

U.S. PATENT DOCUMENTS

| | | | |
|---|---|---|---|
| 4,567,759 | 2/1986 | Ekstrom et al. . | |
| 5,229,976 | 7/1993 | Boyd et al. | 367/73 |
| 5,377,160 | 12/1994 | Tello et al. | 367/86 |
| 5,502,686 | 3/1996 | Dory et al. | 367/86 |
| 5,638,337 | 6/1997 | Priest | 367/73 |
| 5,662,165 | 9/1997 | Tubel et al. | 166/250.01 |
| 5,737,277 | 4/1998 | Priest | 367/73 |

OTHER PUBLICATIONS

"Resistivity While Drilling—Images from the String" by Bonner, et al., Schlumberger Oilfield Review, Spring 1996, vol. 8, No. 1, pp. 4–19 (color copy).

"Classic Interpretation Problems: Evaluating Carbonates" by Akbar et al; Schlumberger Oilfield Review, Jan. 1995, vol. 7, No. 1, pp. 38–57. (color copy).

"Reentry Drilling Gives New Life to Aging Fields", Schlumberger Oilfield Review, Autumn 1996, vol. 8, No. 3, pp. 15, 4–17. (color copy).

"ASI* Array Seismic Imager tool acquires high–quality multilevel, triaxial siesmic data in less time." Schlumberger Wireline & Testing, Sep. 1996, 4 page color brochure (SMP–5131) (original).

"UCI* Ultrasonic Casing Imager quantitatively measures both internal and external casing corrosion." Schlumberger Wireline & Testing, Jun. 1996, 2 page color brochure (SMP–5186) (original).

"CSI* Combinable Seismic Imager tool acquires distortion–free triaxial seismic data", Schlumberger Wireline & Testing, Aug. 1996, 4 page color brochure (SMP–5123) (original).

"Formation Imaging with Microelectrical Scanning Arrays" by Ekstrom, et al., *The Log Analyst,* May–Jun. 1987, pp. 294–306. (Originally published as paper BB in the Transactions from the 1986 SPWLA Symposium).

"Production Logging Horizontal Wells—The Challenges" MKTVIP_14, 1 page color diagram (undated but admitted to be prior art).

"TLC* Tough Logging Condition System", Schlumberger, 1988, 6 page color brochure (SMP–5061) (original).

"Introduction to Mechanics of Solids" by Egor P. Popov, 1968, Library of Congress No. 68–10135, (referenced in Specification at p. 8, lines 25–31), pgs. title page, copyright page, table of contents pgs. ix–xv, index pp. 565–571 and chapters 11 and 12, pp. 378–480.

(List continued on next page.)

*Primary Examiner*—Michael Horabik
*Assistant Examiner*—Timothy Edwards, Jr.
*Attorney, Agent, or Firm*—Gordon G. Waggett; John J. Ryberg

[57] ABSTRACT

A system for creating an image of a combination of a completion string in a wellbore. An image of the wellbore is received and created. In addition, modeled data of the completion string is also created and received. The wellbore image data is combined with the completion string model data to create an image of the completion string positioned in the wellbore. Based on the combined image of the wellbore and a completion string, possible problem areas and optimum production zones are identified. The wellbore and completion string are deflected based on relative characteristics of the wellbore and completion string.

16 Claims, 6 Drawing Sheets

OTHER PUBLICATIONS

"New Formation Evaluation Tools and Interpretation Methods", by W.E. Preeg, Review and Forecast Paper, 14$^{th}$ World Petroleum Congress, May 29, 1994, 16 page color brochure (SMP–1432) (original) (see pp. 7–10).

"Oil–Base mud Dipmeter Tool", Schlumberger ESF–Marketing & Technique, Jun. 1987, 8 page color brochure (M–090195) (original).

"Multiple Wellbore Completions", Baker Oil Tools, 1994, 8 page color brochure. (original).

"Figure #8—Example of Open Natural Fractures at 6341" Nov. 3, 1996, 1 page color diagram.

"Best–in–class formation evaluation", Schlumberger Oilfield Services, undated, 1 page color brochure (undated but admitted to be prior art) (original).

IMAGING A COMPLETION STRING IN A WELLBORE

BACKGROUND

This invention relates to imaging a completion string in a wellbore.

The geometry and orientation of the wellbore and how a completion string sits in the wellbore play a large role in determining the effectiveness of the completion during clean up, treatment, cementing/isolation, and production. Typically, a wellbore extending through a formation is not straight, but rather extends in a snake-like fashion through the formation. Such wellbores typically are spiral-shaped, which results from the rotary motion of the drill bit as the well is drilled.

Even wells which are considered "straight" have variations in deviation and direction. While these variances may be small, they can have an effect, as the clearances between the wellbore walls and the completion string or casing may be quite small. For example, an 8½" inside diameter borehole will often have a 7" outside diameter casing set inside it. This leaves only ¾ clearance on each side.

Problems associated with the unpredictable shape of the wellbore are more pronounced in highly deviated or horizontal wells, which are widely used currently to enhance reservoir production. It may sometimes be difficult to place a completion string, such as a casing, into the wellbore without damaging the completion string. The completion string is not always damaged, but in many cases production is affected or is not optimal.

Logging and imaging tools exist that determine the shape of the wellbore. One such logging tool is a dipmeter, which includes sensors to measure the variations of formation conductivity as the dipmeter passes through the wellbore. Further, the dipmeter has calipers that measure the size of the wellbore continuously, as well as other sensors to measure the deviation and direction of the well. Based on the recorded data, a three-dimensional image along with its position can be created of the wellbore. Other types of instruments can be used to obtain the needed geometric information. For example, a borehole geometry tool (BGT) is basically a dipmeter minus the sensors for taking conductivity measurements. An ultrasonic borehole imaging (UBI) tool works with a general purpose inclinometry tool (GPIT) to obtain the image and position of the well.

The physical characteristics of the geologic formations in the well as well as the amounts and locations of the hydrocarbons in the formation are determined by other logging type tools described elsewhere. In a vertical well, the length of the producing interval may not be that great. However, in a horizontal well, one of the purposes of making the section horizontal is to open up the interval to a long length. Under these conditions, the positioning of the completion string begins to play a large role in the effectiveness of the production as well as possibly how long it will last.

Knowledge of the size, shape, and orientation of the wellbore are an essential part in being able to predict what might happen downhole as the completion string is inserted into the wellbore.

SUMMARY

In general, in one aspect, the invention features a method of creating an image of a combination of a completion sting and a wellbore. An image of the wellbore and model data of the completion string are received. The wellbore image data is combined with the completion string positioned in the wellbore. The data of the wellbore size and position and orientation can be combined with the model of the completion string to predict how the completion string will be positioned inside the wellbore when it is installed.

Implementations of the invention may include one or more of the following features. The image of the wellbore is obtained by an imaging tool. Possible problem areas and optimum production zones are identified based on the combined image of the wellbore and a completion string. The wellbore and completion string are deflected based on relative characteristics of the wellbore and completion string. The completion string includes a casing.

In general, another aspect, the invention features a computer program residing on a computer-readable medium for creating an image of a combination of a completion string and a wellbore. The computer program includes instructions for causing the computer to receive image data of the wellbore and model data of the completion string. The computer program also includes instructions for causing the computer to combine the wellbore image data with the completion string model data to create an image of the completion string positioned in the wellbore.

In general, in another aspect, the invention features a computer-readable storage medium for storing an image representing a wellbore and a completion string, the image data being created by a program executed in a computer. The storage medium includes image data of the wellbore and model data of the completion string. A data structure is created by the program by combining the model data of the completion string with the wellbore image data to represent the image of the completion string positioned in the wellbore.

Implementations of the invention may include one or more of the following features. By providing an image of the completion string (such as a casing), as it would sit inside the wellbore, provides a more accurate determination of how the completion string will behave downhole. Potential problem areas due to irregular shapes of the wellbore can be more accurately identified, as well as identifying the optimal areas for hydrocarbon production.

DETAILED DESCRIPTION

Figure 1:
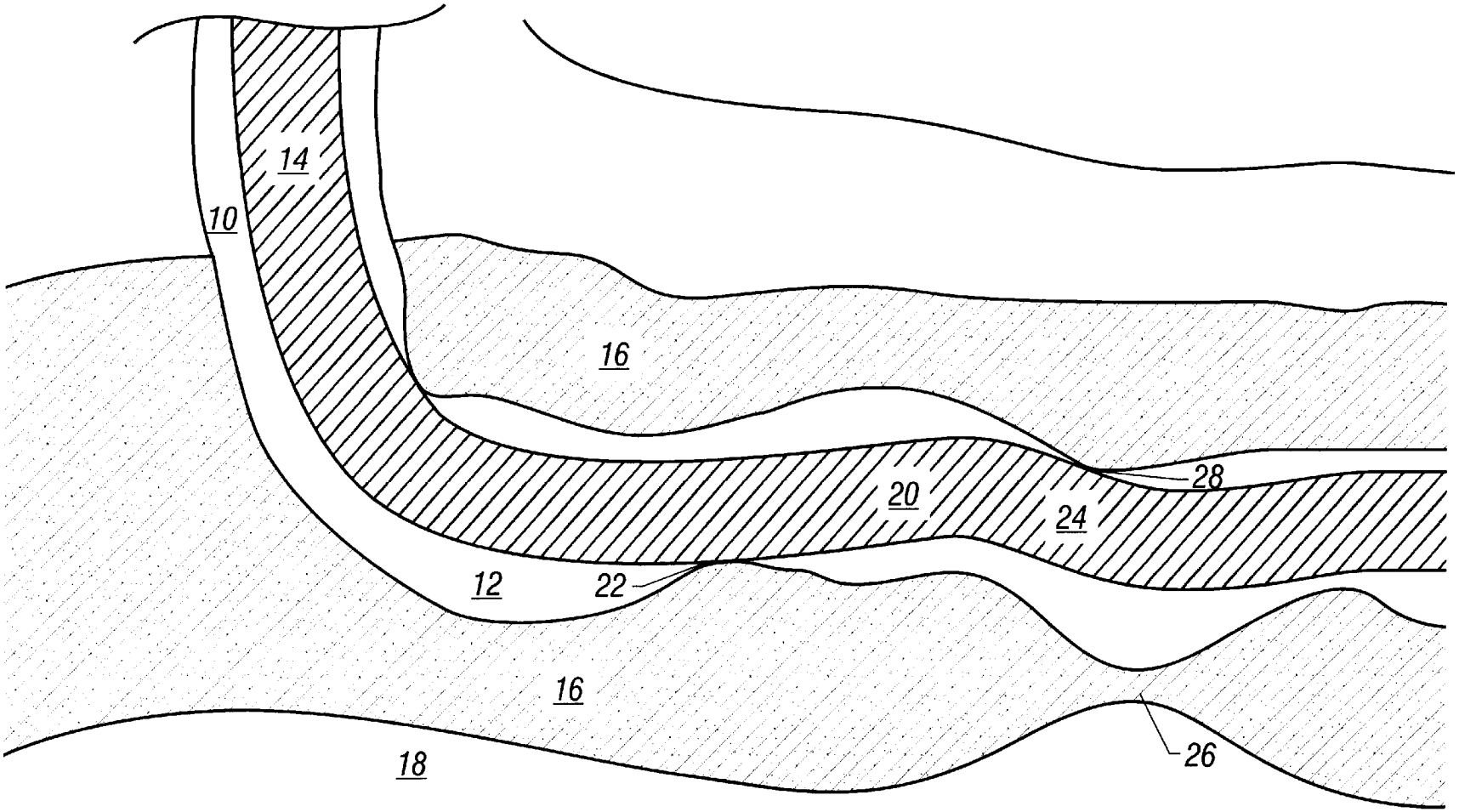
FIG. 1 is a diagram of a casing sitting in a highly deviated wellbore.

Referring to FIG. 1, a wellbore 10 is shown that extends downward from the ground surface and has a highly deviated portion 12 (which is irregularly shaped). The highly deviated portion can be substantially horizontal or inclined (such as at 45° or at other angles). Inside the wellbore 10 is a completion string, such as a casing 14. Other types of completion strings include slotted liners or gravel pack screens. Although the wellbore 10 is shown with an abrupt bend, the bend is much more gradual in an actual wellbore to allow the casing 14 to bend gradually into the highly deviated portion 12.

The highly deviated portion 12 runs generally parallel with a formation 16 that contains producible oil to maximize the amount of wellbore inside the productive formation. Beneath the formation 16 may exist a water layer 18. The casing generally follows the irregular shape of the highly deviated wellbore portion 12, which includes a raised portion 22 and a dipped portion 28. Thus, if the casing 14 is inserted through the wellbore portion 12, the casing 14 would be bent by the S-shaped portion formed from the raised portion 22 and the dipped portion 28. However, until the casing 14 has actually been inserted into the wellbore 10, it would be difficult to determine if the bent portion 24 in the deviated portion 20 of the casing would cause any structural weakness or damage.

Furthermore, it would also be difficult to predict other problem areas caused by the interaction between the casing and the irregularly shaped wellbore.

In practice, very little predictive analytical work is done, and thus most problem areas or weak points are not known until a failure occurs or when the well does not produce as expected. Thus, it is important to find problem areas before the casing is installed as remedial work may be difficult, expensive, or impractical.

Figure 2:
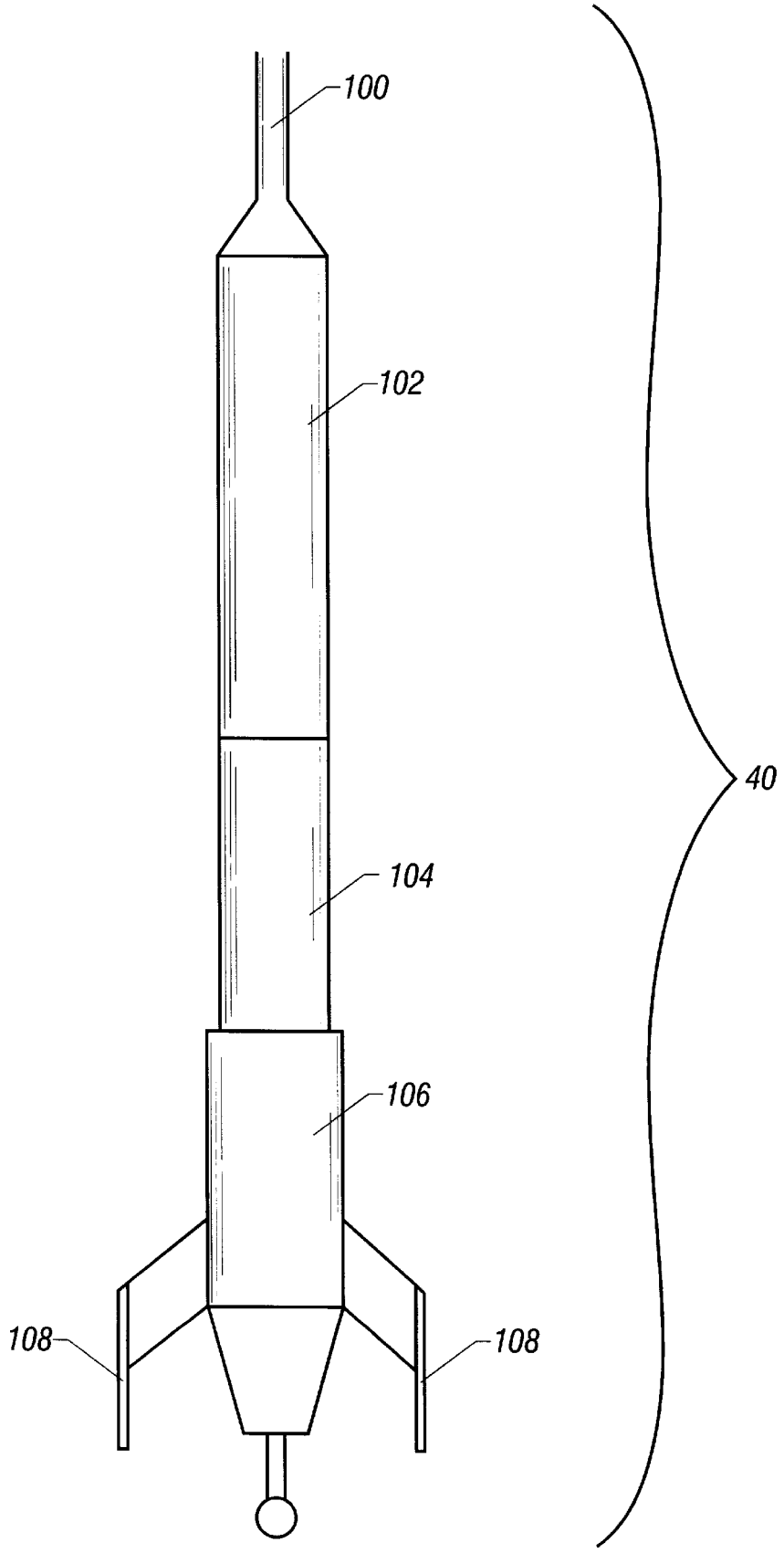
FIG. 2 is a diagram of a dipmeter.

To accurately analyze the behavior of a completion string after insertion into the wellbore 10, two sets of data are obtained: data representing an image of the wellbore and data modelling the completion string. Referring to FIG. 2, to obtain an image of the wellbore 10, a dipmeter 40 is run through the wellbore 10. The dipmeter 40 includes four or more sensor pads 108 at its bottom. The sensor pads 108 measure the conductivity of the formation surrounding the wellbore 10. The dipmeter 40 also includes a measurement module 106 that includes a magnetometer and an accelerometer. The magnetometer measures the orientation of the dipmeter 40 with respect to the magnetic north. The accelerometer measures the acceleration of the dipmeter, which allows later computer processing to determine the speed of the dipmeter 40 as it is passing through the wellbore 10. While the dipmeter 40 is taking measurements, fluctuations of tool velocity are computed from the acceleration measurement and eliminated. In addition, the acceleration measurement is used to determine the relative altitude of the wellbore in three-dimensional space. The dipmeter 40 is assumed to be generally centralized by its arms in the wellbore as well as being collinear with the wellbore. The position of the dipmeter 40 is known by the length of the cable or measured depth of the tool.

Figure 3:
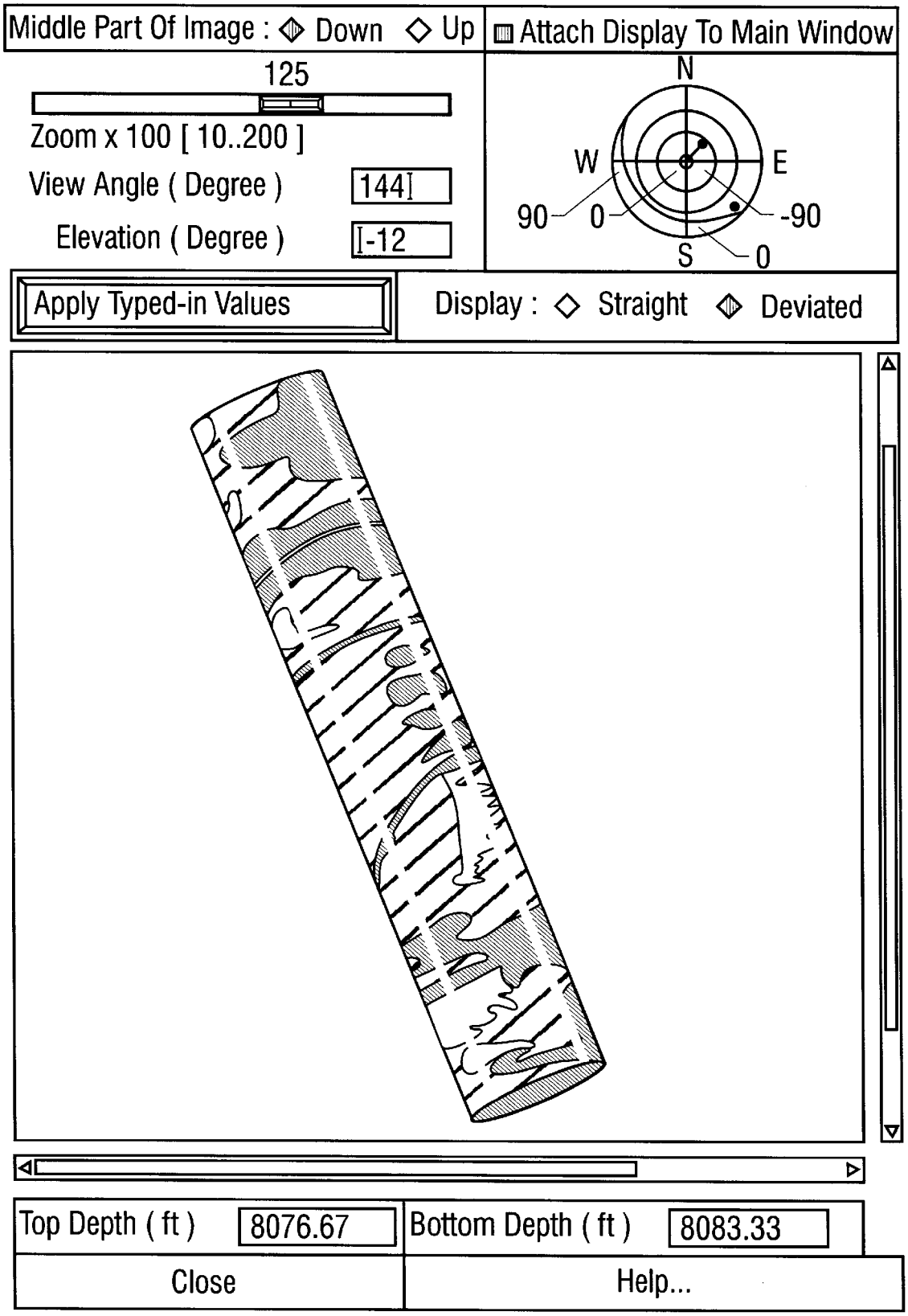
FIG. 3 is a diagram showing an image of a wellbore section.

By combining the information measured by the accelerometer, the magnetometer, and the sensor pads, an image of the wellbore 10 can be created. An exemplary image of a wellbore section is shown in FIG. 3, which was generated by BorView, a software program developed by Schlumberger Technology Corporation to create an image based on measurements taken by a dipmeter.

Alternatively, an image can be obtained without formation conductivity and direction information gathered (such as the size and position of the wellbore in three-dimensional space). Even if information is not available that measures the strength of the well formation, assumptions can be made about the strength of the well formation based on other knowledge, such as general lithology or type of the formation.

The other set of data required to create an image of the completion string and wellbore is a model of the completion string. Both sets of data (for the wellbore and the casing) include the characteristics (e.g., strength, flexibility, etc.) of the completion string and wellbore. Such characteristics are needed to determine how the completion string will behave as it is inserted through the wellbore 10. The completion string is modeled based on the hardware as selected by the operator of the well. For example, if the completion string is a casing, it would be modeled as a cylindrical, steel pipe having multiple sections joined together. The strength and other structural characteristics of the pipe are known.

The main productive intervals are identified using the data from the formation evaluation tools. Possible problem areas can exist inside these intervals.

Figure 4:
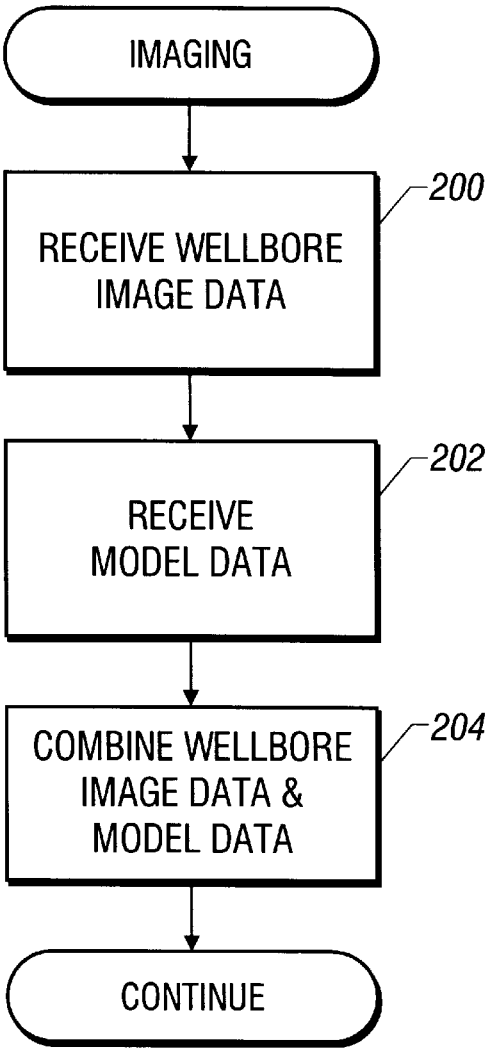
FIG. 4 is a flow diagram for generating the image of a completion string as it is position inside a highly deviated wellbore.

Referring to FIG. 4, an imaging acquisition and control program for producing the image of the completion string positioned inside a highly deviated wellbore is described. The imaging program receives, at 200, the wellbore image data measured by a logging tool, such as the dipmeter 40. The wellbore image data can be in any number of formats. Next, at 202, the completion string model data is received. Then, at 204, the wellbore image data and the completion string model data are combined to provide an image of the completion string as it is positioned inside the wellbore 10.

Figure 5:
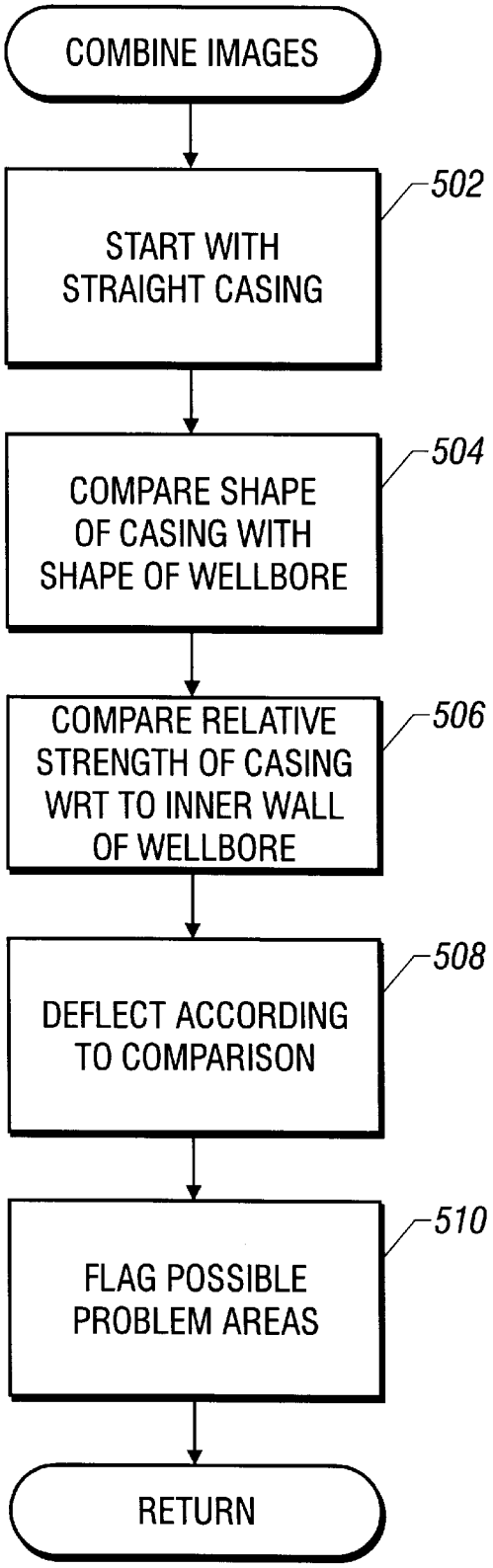
FIG. 5 is a flow diagram of the steps to combine the wellbore image data and the completion string model data.

Referring further to FIG. 5, the step (204) of combining the wellbore image data and the completion string model data is shown in greater detail. First, at 502, the casing model starts out as a straight piece of casing, just as a casing would before it is inserted down the wellbore. At 504, the shape of the casing is compared with the shape of the wellbore. At points where the casing has to be bent, the relative strength of the casing and the inner walls of the wellbore 10 are compared. As a result of that comparison, either the inner wall of the wellbore or the casing (or both) is deflected at 508. There deflections can then be used to determine the stresses and forces involved. Next, at 510, all potential problem areas are flagged.

Figure 8:
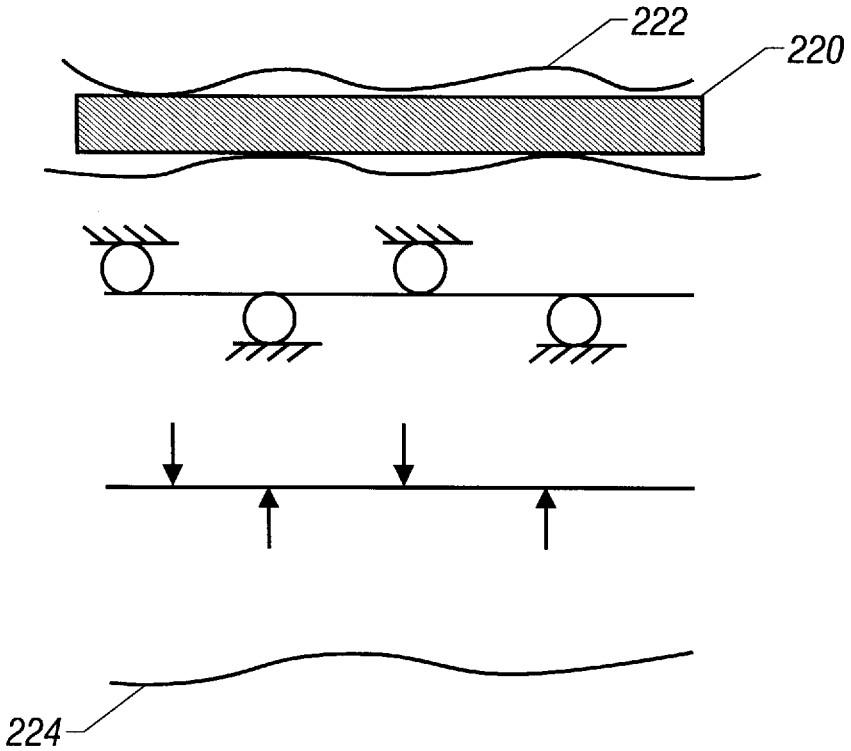
FIG. 8 is a diagram illustrating how the casing/wellbore combination can be modeled.

One method of modeling contact points between the completion string (such as a casing) and the wellbore is illustrated in FIG. 8, in which a relatively straight casing 220 is initially placed in a irregularly shaped wellbore. The contact points between the casing and the inner wall of the wellbore are modeled as roller-type contacts, and the casing is initially represented as a straight line. Using such a model, the casing is free to move laterally, but forces (represented as vectors) exerted by the wellbore inner walls push against the casing. The roller contact example is an illustration of how a portion of the wellbore and completion string can be modeled. In other situations, other known methods of representing the wellbore and completion string can be used. Further, although the example of FIG. 8 illustrates the completion string and wellbore in two-dimensional space, they are actually in three-dimensional space.

FIG. 8 illustrates what is commonly referred to as the statically indeterminate problem, which can be solved by a known method such as the "moment-area method" or the "three moment method," described in Egor P. Popov, "Introduction to Mechanics of Solids," Library of Congress No. 68-10125 (1968), which is hereby incorporated by reference.

The deflection of the casing, represented by the line 224, is determined by the physical shape of the wellbore and the relative mechanical characteristics of the casing and wellbore, as well as the resulting forces and moments that allow determination of the deflection of the casing along its entire length. The resulting deformations can then be used to determine the forces and stress in the casing.

If the casing 14 has to be bent or deformed by such an amount that it will lose its structural integrity, then those areas are flagged. The imaging tool can also identify locations in the deviated wellbore where centralizers need to be attached to the outer surface of the casing such that the casing would be as centered as much as possible inside the wellbore. For example, in FIG. 1, a place where a centralizer might be helpful is at point 22, where the casing 14 is lying against the formation. Centering the casing in the wellbore 10 is necessary to properly cement the casing to the wellbore. Also, the imaging tool can identify naturally centralized areas (of the casing with respect to the wellbore) at which cement will form the best isolation zones.

Figure 7:
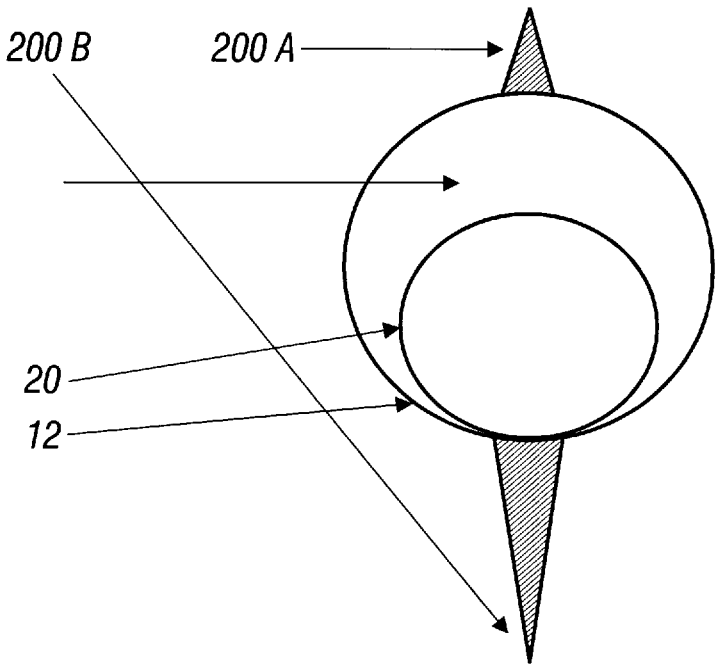
FIG. 7 is a cross-sectional view of a casing inside a wellbore.

An example of a problem area is a narrowed portion 26 of the formation 16 that sits below the dipped portion 28 of the wellbore 10 (FIG. 1). It is undesirable to perforate in such narrowed section 26 as a perforation would be created through the formation 16 and into the water layer 18. When that occurs, water will be produced into the wellbore along with oil. In addition, the raised position 22 causes the casing 20 to be decentralized. If perforated at that location, the perforations will extend unevenly, such as perforations 200A and 200B in FIG. 7, which is a cross-sectional view of the wellbore and casing at line A—A. On the bottom side, increased stress on the sand face may increase undesirable sand production, while on the other side, the perforations may not be deep enough, resulting in poor production through those perforations.

Other problem areas include the following. Mud might be trapped and not easily displaced in some areas. There may be areas at which cement may not flow naturally as it is blocked by casing-formation contact. There may be locations in which the casing-formation contact may result in poor isolation. For example, external casing packers are often used in conjunction with cement pumped behind the casing to provide hydraulic isolation of the casing-formation annulus. In areas such as at point 22, a packer may not inflate properly, as it is pinned against the wellbore wall. There also may be areas in which treatments such as acid will be difficult to displace later, this trapped acid can lead to premature casing failure. Some areas of the wellbore need to be packed with gravel, which are done either to add support for the formation or to provide a filter for slotted lines in the casing. There may be areas in which the gravel may not be easily inserted due to poor isolation between the casing and wellbore.

Additionally, by identifying the position of the casing inside the wellbore, the optimum production areas can be identified. For example, more accurate selection of production intervals can be performed to maximize production; areas of best centralization of the casing within the wellbore combined with best potential hydraulic isolation are good candidates. The more accurate depiction of the casing as it would lay inside the wellbore would also allow optimum placement of completion hardware, such as lateral completion modules, as well as other standard completion and casing hardware such as centralizers.

Figure 6:
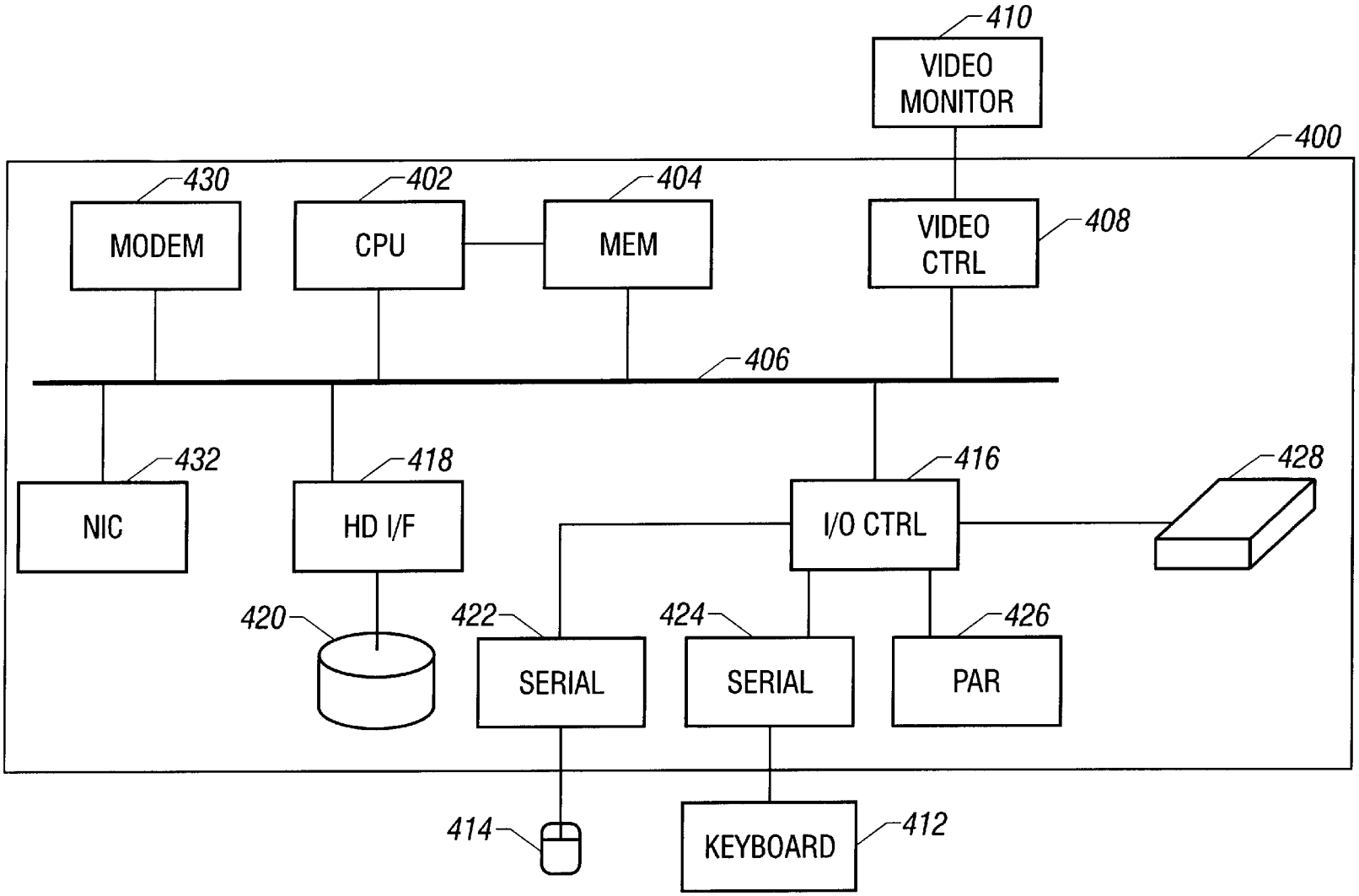
FIG. 6 is a block diagram of a computer system on which an imaging tool can be operated.

Referring to FIG. 6, the imaging acquisition and control program described above can be implemented in a computer system 400. The imaging tool can be stored as an application program on a floppy diskette, with the program loaded into the computer system through its floppy disk drive 428.

The floppy disk drive 428 is connected to an input/output (I/O) controller 416, which is further connected to serial ports 422 and 424 (for connection to a pointer device 414 and keyboard 412, respectively) and a parallel port 426. The I/O controller 416 is connected to a host bus 406.

A central processing unit (CPU) 402 is connected on the bus 406, as is a main memory 404. During execution, the imaging program is stored in the main memory 404 and runs on the CPU 402.

Images produced by the imaging program are displayable on a video monitor connected to a video controller 408, which is in turn connected to the host bus 406 to receive the video data.

A hard disk drive controller 418, also connected to the host bus 406, is connected to a hard disk drive 420, which forms the mass storage device in the computer system 400. Portions of the imaging program are also stored on the hard disk drive.

The image data files for the completion string and wellbore are loaded into the computer system 400 for processing and display. The data files can be stored on floppy diskettes and loaded through a floppy disk drive 428, downloaded through a modem 430 connected to the host bus 406, or retrieved by a network interface card (NIC) 432 from a network (not shown). During processing by the imaging program, the image data files can be stored in the hard disk drive 420 or the main memory 404.

Other embodiments are within the scope of the following claims. For examples, different methods and tools can be used to collect the image data for the wellbore and the completion string, such as a borehole geometry tool or the combination of an ultrasonic tool and a general purpose inclinometry tool.

What is claimed is:

1. A method of creating an image of a combination of a completion string and a wellbore, comprising:

receiving an image of the wellbore;

receiving model data of the completion string; and combining the wellbore image data with the completion string model data to create an image of the completion string positioned in the wellbore.

2. The method of claim 1, wherein the image of the wellbore is obtained by an imaging tool.

3. The method of claim 1, further comprising:

identifying possible problem areas based on the combined image of the wellbore and completion string.

4. The method of claim 1, further comprising:

identifying optimum production zones based on the combined image of the wellbore and completion string.

5. The method of claim 1, wherein the combining step includes deflecting the wellbore and completion string based on relative characteristics of the wellbore and completion string.

6. The method of claim 1, wherein the completion string includes casing.

7. A computer system in which a program is executable for creating an image of a combination of a completion string and a wellbore, the computer program comprising instructions for causing the computer system to:

receive image data of the wellbore;

receive model data of the completion string; and combine the wellbore image data with the completion string model data to create an image of the completion string positioned in the wellbore.

8. The computer system of claim 7, wherein the image data of the wellbore is obtained by an imaging tool.

9. The computer system of claim 7, wherein the program further comprises instructions for causing the computer to identify possible problem areas based on the combined image of the wellbore and completion string.

10. The computer system of claim 7, wherein the program further comprises instructions for causing the computer to identify optimum production zones based on the combined image of the wellbore and completion string.

11. The computer system of claim 7, wherein combination of the wellbore image data with the completion string model data includes deflecting the wellbore and completion string based on relative characteristics of the wellbore and completion string.

12. The computer system of claim 7, wherein the completion string includes casing.

13. A computer-readable storage medium for storing an image representing a wellbore and a completion string, the image data being created by a program executed in a computer, the storage medium comprising:

image data of the wellbore;

model data of the completion string; and data structure created by the program by combining the model data of the completion string with the wellbore image data to represent the image of the completion string positioned in the wellbore.

14. The computer-readable storage medium of claim 13, further comprising:

data created by the program identifying possible problem areas based on the combined image of the wellbore and completion string.

15. The computer-readable storage medium of claim 13, further comprising:

data created by the program identifying optimum production zones based on the combined image of the wellbore and completion string.

16. The computer-readable storage medium of claim 13, further comprising:

characteristics of the wellbore and completion string, wherein the completion string model data and wellbore image data are combined by deflecting the completion string and wellbore based on the relative characteristics of the wellbore and completion string.

* * * * *